US006775862B1

(12) United States Patent
Christensen

(10) Patent No.: US 6,775,862 B1
(45) Date of Patent: Aug. 17, 2004

(54) WHIRLPOOL BATHTUB WITH RELEASABLE BOTTOM ELEMENT

(75) Inventor: Kjell Christensen, Sandefjord (NO)

(73) Assignee: Fjordbad AS, Sandefjord (NO)

( * ) Notice: Subject to any disclaimer, the term of this patent is extended or adjusted under 35 U.S.C. 154(b) by 0 days.

(21) Appl. No.: 10/088,535

(22) PCT Filed: Sep. 19, 2000

(86) PCT No.: PCT/NO00/00307

§ 371 (c)(1),
(2), (4) Date: Aug. 7, 2002

(87) PCT Pub. No.: WO01/21130

PCT Pub. Date: Mar. 29, 2001

(30) Foreign Application Priority Data

Sep. 20, 1999 (NO) ..... 19994567

(51) Int. Cl.[7] ..... A61H 33/02

(52) U.S. Cl. ..... 4/541.1; 541/541.3; 541/541.5; 541/584

(58) Field of Search ..... 4/541.1, 541.3–541.6, 4/584

(56) References Cited

U.S. PATENT DOCUMENTS

| | | | | | |
|---|---|---|---|---|---|
| 3,623,482 | A | * | 11/1971 | Schmidt et al. | 601/168 |
| 3,870,040 | A | * | 3/1975 | Klages | 601/168 |
| 4,101,988 | A | * | 7/1978 | Sierant | 4/541.4 |
| 4,213,210 | A | * | 7/1980 | Scourtes | 4/541.5 |
| 4,546,505 | A | * | 10/1985 | Wakenshaw | 4/541.3 |
| 4,780,916 | A | * | 11/1988 | Sutton | 4/541.5 |
| 4,918,768 | A | | 4/1990 | DeSousa et al. | 4/542 |
| 4,953,240 | A | * | 9/1990 | Gardenier | 4/541.3 |
| 5,083,329 | A | * | 1/1992 | Murakami | 4/541.4 |
| 5,381,831 | A | | 1/1995 | Versland | 137/868 |
| 5,448,787 | A | * | 9/1995 | Allen | 4/559 |
| 5,896,596 | A | * | 4/1999 | Murakami | 4/541.1 |
| 6,009,574 | A | | 1/2000 | Moreland | 4/541.5 |

FOREIGN PATENT DOCUMENTS

| | | |
|---|---|---|
| CA | 2039801 | 6/1991 |
| DE | 26 02 472 | 7/1976 |
| DE | 44 13 016 | 10/1995 |
| EP | 0 450 396 | 9/1991 |
| GB | 1 550 361 | 8/1979 |
| GB | 2 217 986 | 11/1989 |
| GB | 2 224 203 | 5/1990 |
| GB | 2 288 975 | 11/1995 |
| NO | 301031 | 1/1997 |

OTHER PUBLICATIONS

Hurricane (illustrated in product brochure from Fjordbad AS, dtd. Feb. 1, 1998) w/English translation.

* cited by examiner

*Primary Examiner*—Henry Bennett
*Assistant Examiner*—Amanda Flynn
(74) *Attorney, Agent, or Firm*—Finnegan, Henderson, Farabow, Garrett & Dunner, L.L.P.

(57) ABSTRACT

A whirlpool bathtub and a valve device for such a tub. The tub has a molded tub part and at least one, preferably two removable, circular bottom elements which match recesses in the tub part. The bottom elements can be attached to the tub part by means of central screws. From an external pump device, air is supplied to the valve device and on to preferably two defined chambers in the tub, each of which is composed of a recess with an associated bottom element. Each bottom element has apertures for the supply of air from the chambers to the water in the bathtub. The valve device simultaneously constitutes a bottom valve for draining water from the tub to a plug hole. The tub is easy to keep clean, and may in addition be manufactured in a simple and cost-effective manner.

7 Claims, 3 Drawing Sheets

WHIRLPOOL BATHTUB WITH RELEASABLE BOTTOM ELEMENT

BACKGROUND OF THE INVENTION

The invention relates to a whirlpool or massage bathtub, comprising a tub part with a bottom which is provided with through-flow apertures for the supply of air to water in the whirlpool bathtub, and with devices for supplying air to the through-flow apertures.

The invention also relates to a valve device for a whirlpool bathtub, for supplying air to the whirlpool bathtub and draining water from the whirlpool bathtub.

Whirlpool or massage bathtubs are essentially based on two principles: hydromassage, where jets of water are ejected from the walls of the tub, and air systems, where the water in the tub is set in motion by air bubbles which are supplied from the bottom of the tub and possibly also the walls. Combinations of these two principles have also been employed.

Traditionally, whirlpool or massage bathtubs based on these principles have resulted in solutions where water or air is supplied from a pump device, through a system of hoses or pipes, to nozzles mounted in the bottom or the walls of the tub.

There are major disadvantages connected with such solutions. The most important objection is associated with cleaning. A system of hoses or pipes creates the basis for so-called biofilm, which results in the growth of algae, bacteria and fungi, and in such a system it is difficult to gain access for cleaning. Circulating water with added cleaning fluids can partially redress this problem, but a more thorough cleaning process requires access for mechanical washing with brushes or the like, which has been shown to be difficult or impossible to accomplish with the closed hose or pipe systems.

An important requirement for whirlpool or massage bathtubs is that they should be able to be manufactured from/with simple, cost-effective materials, components and methods. A tub based on extensive use of hoses and pipe connections does not fulfil this requirement.

A whirlpool or massage bathtub is known in the prior art where some of the above drawbacks are partially overcome. On the market there is a whirlpool or massage bathtub by the name of Hurricane (illustrated, e.g., in the product brochure "the only one which is washable . . . " from Fjordbad AS, dated 1, Feb. 1998). This bathtub is a whirlpool bath where air is supplied from a pump device to nozzles mounted in the bottom of the tub. However, the pump device is not connected to the nozzles by means of hoses or pipes. Instead, the tub is equipped with a removable, upper bottom element in the form of a plate, matching the shape immediately above the bottom of the bathtub, where the nozzles are composed of apertures in the upper bottom element. Together with the bottom of the actual tub, the upper bottom element forms a defined chamber to which air is supplied from the pump device. During operation the chamber is placed under higher air pressure than atmospheric pressure, and the air is distributed to the individual nozzles, where it flows out, producing a whirlpool and massaging effect in the water in the tub, on the top of the removable bottom element.

This solution offers the possibility of more efficient cleaning. The upper bottom element can be removed from the tub by means of four screws, whereupon those parts of the tub and the bottom element which together form the interior of the chamber can be efficiently cleaned by simple means and with easy access.

This known solution overcomes many of the said disadvantages associated with cleaning, but it has also been shown to involve new problems.

One significant problem is the technical difficulties connected with producing a removable bottom element which will exactly match the shape of the bathtub, and which will provide a tight seal with the lower part of the tub's walls while the chamber under the bottom element is placed under air pressure from the pump device. This problem can be solved by means of gaskets, but this solution should be avoided, since it can create new problems with the growth of bacteria and the like in connection with the gaskets. The manufacture of a hard, upper bottom element which provides a tight seal without the use of gaskets has been shown to require complicated and costly production processes, which depend, amongst other things, on the extensive use of manual craftmanship.

Another problem with the known solution is that the removable, upper bottom element is heavy and relatively difficult for the user to release and lift out. The known, upper bottom element has a weight of 13 kg, and 4 screws have to be loosened, whereupon it has to be lifted out by means of a special tool in the form of a lifting ring. This cumbersome process has in many cases led to a tendency for the tub not to be cleaned as often and as thoroughly as was intended.

A further drawback with the known solution is that the bottom element will require a fixed, predetermined distribution of air aperture over the surface of the bottom element. This offers no opportunity for a user to select and very the areas which will be provided with air apertures, and which areas will not.

The known solution also makes it difficult and expensive to replace the bottom element with another, if it is desirable to alter certain characteristics such as the number, size and distribution of air apertures for the bottom element.

EP-A-0 450 396 discloses a device for use with a bathtub, where a mixture of air and water is supplied to the water in the bathtub by means of an external pump. The bathtub bottom is provided with a recess, delimited at the top by a cover, constituting a chamber which is further divided into sections for feeding air/water mixture and for return of water, respectively. The cover is detachable by means of clips. Apparently, the publication does not address the problem of simultaneously providing satisfactorily sealing, effective and convenient cleaning, simple manufacturing and preventing the growth of bacteria etc.

GB-A-2 217 986 discloses a drainage valve for a whirlpool tub, arranged for simultaneously draining of the bathtub and assocoated pipework. The publication does not address the problem of providing a valve for both supplying air into the bathtub and draining water from the bathtub. Particularly, the publication does not disclose a special valve geometry which provides for short tubing lengths, thereby facilitating easy access and convenient cleaning.

The object of the present invention is to provide a whirlpool bathtub and a valve device as mentioned in the introduction, which is not encumbered by the above disadvantages.

SUMMARY OF THE INVENTION

The object is achieved with a whirlpool bathtub comprising a tub part with a bottom which is provided with through-flow apertures for supplying air to water in the whirlpool bathtub, and devices for supplying air to through-flow apertures, characterized in that the bottom is provided with at least one recess which is flow-relatedly connected with the devices for supply of air, that each recess is surrounded by a substantially horizontal sealing edge, that each recess is covered by a bottom element which abuts sealingly against the recess's sealing edge, with the result that the recess and the bottom element together form a distributing chamber for air, and that the bottom elements are provided with through-flow apertures for air from the supply chambers to water in the whirlpool bathtub.

It is also achieved with a valve device for a whirlpool bathtub, for supplying air to the whirlpool bathtub and drawing water from the whirlpool bathtub, characterized in that it comprises a valve housing, at least two horizontal outlets for air, a substantially vertical inlet for water and a substantially vertical outlet for water, the outlets for air are provided in a plane between the inlet for water and the outlet for water, and it comprises a valve for closing the outlet for water, comprising a substantially horizontal valve seat in the housing and a vertically movable closing body which by means of a lifting device is movable between an open position where water is permitted to flow through the valve device and a closed position where an outlet closing portion of the closing body abuts against the valve seat, closing the outlet for water.

BRIEF DESCRIPTION OF THE DRAWINGS

The invention will now be described in more detail with reference to the drawings, in which.

DETAILED DESCRIPTION OF THE INVENTION

Figure 1:
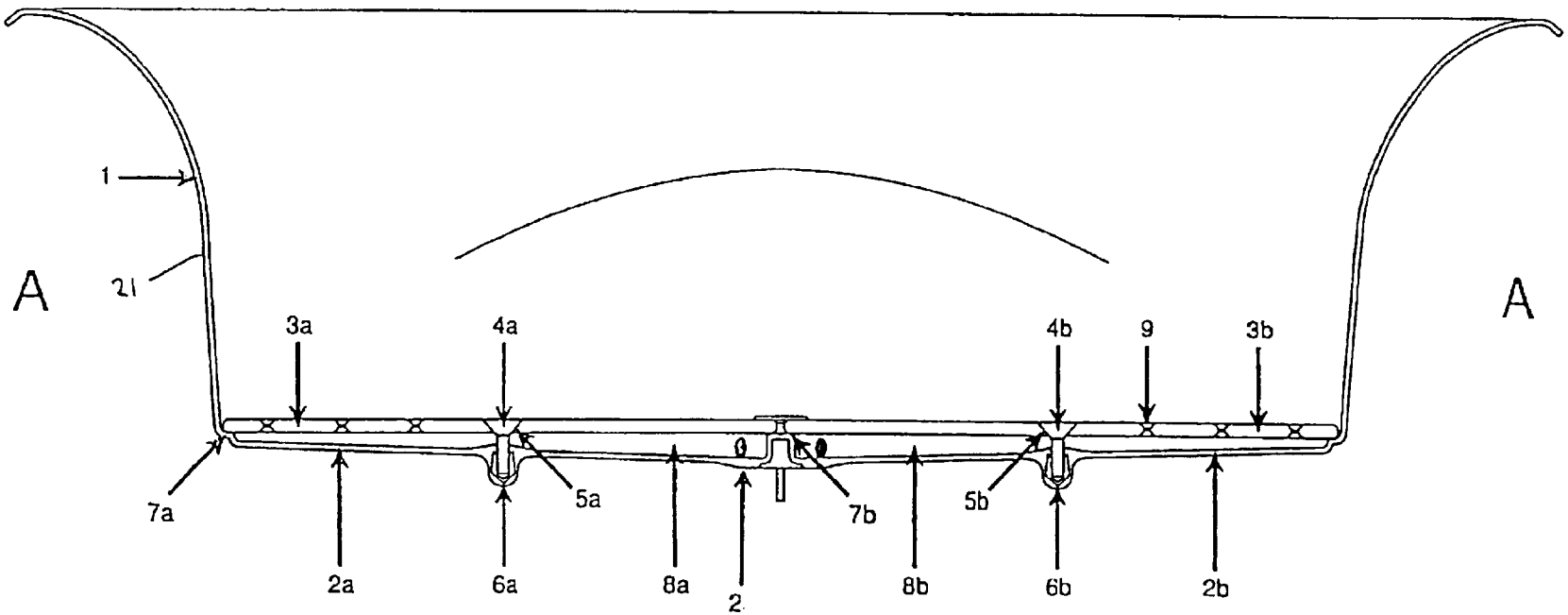
FIG. 1 illustrates a cross section of a bathtub according to the invention, taken along the intersecting line A—A in FIG. 2.

FIG. 1 illustrates a cross section of a bathtub 1 according to the invention. The tub 1 consists of a tub part 21 comprising walls and a bottom 2 with two recesses 2*a* and 2*b*. Each recess is bounded and surrounded by a preferably rounded edge or rim, designated by 7*a* and 7*b* respectively, each of which has at least one substantially horizontal, upper portion. The substantially horizontal portion advantageously has a width in the horizontal direction in the range of 3 mm to 10 mm, and specially preferred around 5 mm.

The tub part 21 is advantageously molded from an artificial fiber material, preferably glass-fiber reinforced polyester, but it may alternatively be made in other known ways such as, e.g., vacuum forming of sheet material, for example acryl. In the illustrated, preferred embodiment the recesses 2A, 2*b* are circular and of equal size. Even though the circular shape offers special advantages, the recesses may well have a different shape within the scope of the invention. The recesses may have different sizes, and their number may differ from two.

The recesses are arranged to be covered by two bottom elements or bottom elements 3*a* and 3*b*. When the bottom elements 3*a*, 3*b* are arranged for covering the recesses 2*a* and 2*b*, each bottom element 3*a*, 3*b* abuts closely against the horizontal, upper portion of the edges 7*a* and 7*b* respectively which surround the recesses. The bottom elements 3*a*, 3*b* are designed with a shape corresponding to the edges 7*a*, 7*b* of the recesses, and are slightly larger than the recesses 2*a*, 2*b*, with the result that when they are placed over the recesses 2*a*, 2*b*, they define chambers 8*a*, 8*b*. The adaptation in the radial direction between the bottom elements and the edges surrounding the recesses does not require a particularly high degree of precision, since it is not crucial for the sealing between the bottom elements and the edges 7*a*, 7*b* of the recesses. On the other hand, the bottom elements and the edges surrounding the recesses both require to be flat, which is far easier to achieve than an exact match between the shape of the edges and that of the bottom elements in the radial direction.

Each of the bottom elements is equipped with a hole 5*a*, 5*b* for attachment, a screw 4*a*, 4*b* being placed between each hole and screwed into threaded attachment devices 6*a*, 6*b* in the bottom of the tub part 21. In the illustrated embodiment the attachment devices comprise threaded sleeve 6*a*, 6*b*, for example of brass, moulded into the bottom of the tub part 21. The holes 5*a*, 5*b* in each bottom element 3*a*, 3*b* are preferably located in the centre of the bottom element. The screws 4*a*, 4*b* are advantageously made of a plastic material, and they preferably have a head which is adapted to countersinks in the holes 5*a*, 5*b*. The head of the screw is preferably equipped with means for manual influence without the use of tools, such as, for example, indentations suitable for two fingers. The screws, however, may be of another suitable type or material, or alternatively use may be made of other, known per se attachment means for bringing the bottom elements into releasable, sealed connection with the edges 7*a*, 7*b* round the bottom's recesses 2*a*, 2*b*.

The bottom elements are further equipped with a number of apertures 9 which represent air nozzles where air under pressure from the chambers 8*a*, 8*b* is supplied to the water in the tub. By varying the size and/or number of apertures, different characteristics can be obtained for the massaging effect which is produced by the apertures when the bathtub is used. In a preferred standard embodiment, which provides a normal massaging effect, each bottom element has 28 apertures, each with a diameter of 6 mm. In an alternative embodiment, which provides a softer massaging effect, each bottom element has 63 apertures, each with a diameter of 4 mm. With 10 apertures, each with a diameter of 10 mm, a considerably harder massage is obtained. When using an alternative number of apertures it is an advantage to adapt the area of each aperture in such a way that the total area of all the apertures is approximately constant. This is due to the fact that it is desirable to have an optimal, not excessive overpressure in the chamber under the bottom element. This in turn is due to the fact that such an overpressure leads to undesirable temperature reduction in the air when it leaves the chamber and is discharged into the water. The greater the pressure difference between the chamber and the surroundings, the greater the temperature reduction.

The shape of the apertures 9 is preferably circular, but other known per se shapes for nozzle apertures may be employed. If so desired, known per se inserts may be placed in the apertures, for example in the form of an umbrella-shaped cover over the aperture, in order to achieve special air flow or massaging effects. In order to ensure thorough cleaning and overall efficiency and comfort, however, use is preferably made of circular apertures with no such inserts.

Figure 2:
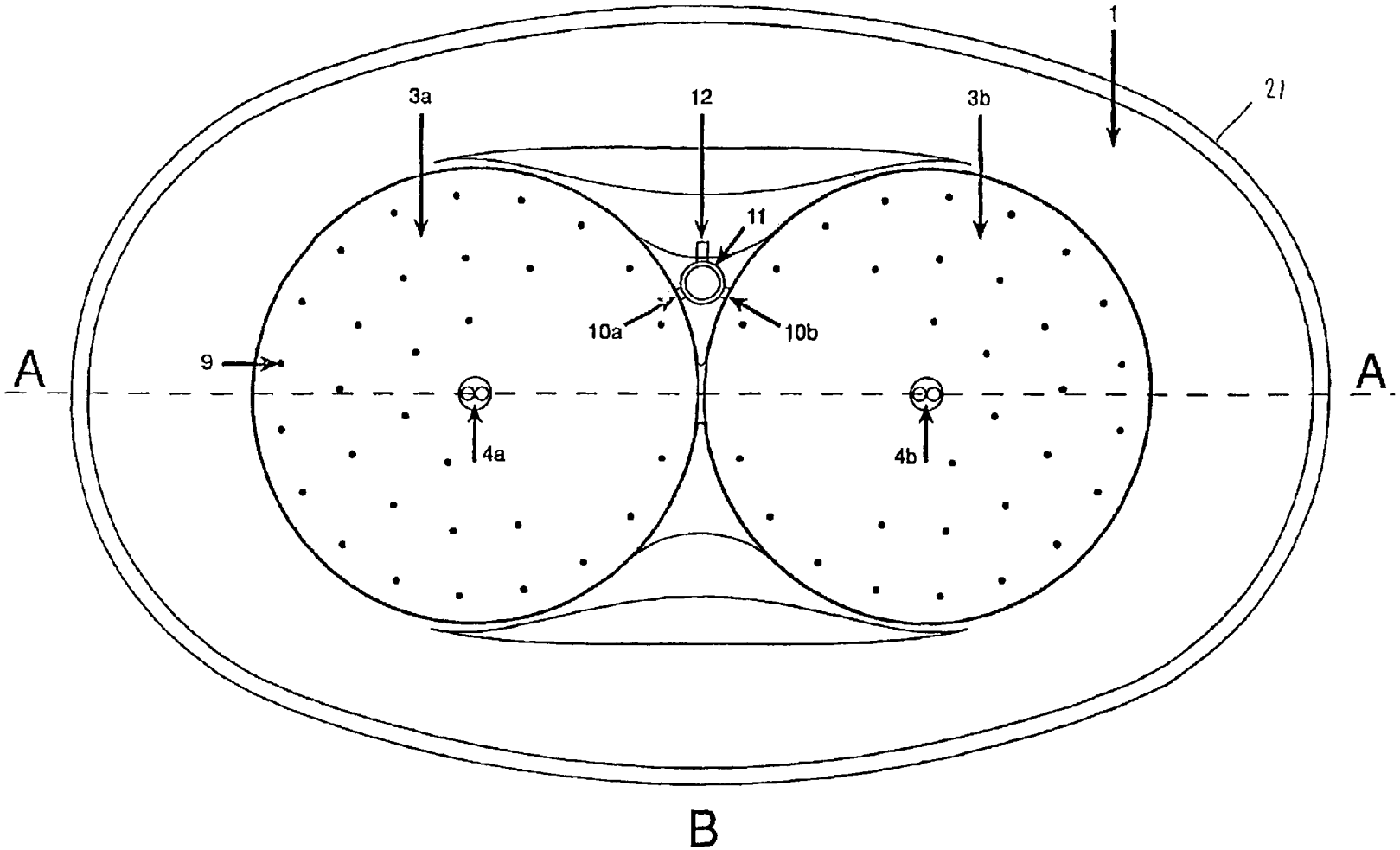
FIG. 2 is a top view of a bathtub according to the invention.

The apertures 9 may be distributed over substantially the entire bottom element 3*a*, 3*b*. Air nozzles/apertures 9 which are placed directly in contact with certain body parts, particularly the abdomen, of a user of the bathtub, however, may cause the user discomfort or inconvenience. It is therefore an advantage to omit apertures in an area of the bottom element 3*a*, 3*b*, as illustrated in FIG. 2. In such a case, when installing the bottom elements 3*a*, 3*b*, it is possible to choose which parts of the tub's total bottom area should be without apertures 9. This is done by rotating each bottom element 3*a*, 3*b* to a desired angular position over the recesses 2*a* and 2*b* respectively, in the horizontal plane. This is possible since the bottom elements 3*a*, 3*b* are circular, and since the attachment holes 5*a*, 5*b* are arranged in the centre of the bottom elements.

The horizontal portion of the rim surrounding each recess is completely flat in the illustrated embodiment in FIG. 1. If the bottom element is displaced slightly from its centre position, and the rounded edge of the bottom element thereby abuts against a curved portion of the wall of the bathtub, the result may be that the bottom element is slightly raised from its seat, and leakage may occur. If the curvature of the bottom element and the curved portion of the wall of the bathtub are designed to exactly agree, this problem will not arise, but in practice the tolerance requirements should not be too great for the match between the said curvatures.

In order to prevent the above-mentioned situation, in an alternative embodiment (not illustrated), the horizontal portion of the rim surrounding each recess is also provided with a raised back or ridge which extends along the entire rim surrounding the recess. The back advantageously has a height between 0.2 and 2.0 mm, and specially preferred around 1.0 mm. The back, moreover, has a width in the range of 4 to 8 mm, and specially preferred around 6 mm. The raised back's upper cross sectional surface is rounded, and advantageously is approximately in the form of a circular arc. This alternative embodiment results in the bottom element, if it is slightly displaced from its centre position, abutting against a perpendicular portion of the wall of the tub part, and not against the curved portion. Thus further contributes, therefore, to preventing leakage between the rim and the bottom element.

FIG. 2 is a top view of a whirlpool bathtub 1 according to the invention, where a valve device 11 in connection with the lower bottom of the tub is also illustrated, even though it is actually located embedded in the tub part 21 and thus in reality is not visible. In FIG. 2 a line A—A is shown, indicating the section which is illustrated in FIG. 1, and the letter B indicates from which direction FIG. 1 is viewed. The valve device 11 is intended to provide supply of a first fluid to the chambers 8*a*, 8*b* and emptying of a second fluid from the tub to a plug hole. The valve device 11 has an inlet 12 for a first fluid, which is usually air. When the whirlpool bathtub is in operation, the valve device 11 distributes the air to two outlets 10*a*, 10*b*, which transfer the air to the chambers 8*a*, 8*b*. The inlet 12 and the outlets 10*a*, 10*b* consist of pipes with a circular cross section, which for the reasons mentioned at the beginning concerning harmful formation of algae, bacteria, etc., should be made as short as possible. The valve device 11 is therefore mounted at a short distance from the two chambers 8*a*, 8*b*, and also preferably at a short distance from a pump device (not illustrated). It is particularly important that a substantially horizontal part of the connection between the pump device and the inlet 12 should be made as short as possible, since the problem of deposits and growth formation is greatest in horizontal portions of such connections.

In FIG. 1 it is indicated that the top of the tub 1 may have an oval shape, but other suitable shapes are equally suitable, for example, kidney-shaped, super-elliptical, egg-shaped, hexagonal, rectangular, rectangular with one or two convexly curved sides, or rectangular with rounded corners. Where the tub is equipped with more than two recesses and bottom elements, for example three, the upper edge of the tub may, for example, assume the form of a circle, a trefoil, a triangle, a triangle with rounded corners, a quarter circle or a quarter circle with a rounded corner. In its simplest form, the tub has only one recess and one bottom element.

The above examples require that the recesses with associated bottom elements should lie substantially in the same horizontal plane. The invention, however, is not limited to such embodiments. In a special embodiment the tub may include five recesses with associated bottom elements, four of which are peripherally arranged in a first, upper horizontal plane in a trefoil pattern, with the result that the centres of the recesses form the corners of a square, while the fifth recess is centrally arranged in a second, lower located horizontal plane, symmetrically centred between the first four. A tub of this kind is well-suited to simultaneous use by four people, the first four bottom elements forming seats, while the lower, fifth bottom element forms a central recess for the feet of the bathers. In this case channels have to be provided for transport of fluid, both air and water, between each of the four peripheral recesses and the fifth, central recess. Such channels can involve a risk of the formation of undesirable growth, and it must therefore be made as short as possible, while being sufficiently large in cross section to be easily accessible for mechanical cleaning, e.g. with brushes. In this case a valve device for both supply of air from a pump device and for emptying water from the tub is mounted in the fifth, central recess.

For each embodiment of the tub the bottom elements may advantageously be made of an artificial fibre material, and preferably of a completely or partly transparent material. In the choice of material, account should be taken, amongst other things, of the fact that the bottom elements must be able to withstand the air pressure and changes in the air pressure inside the chambers during repeated start-ups and over a long period, without causing leakages between the bottom elements and the edges 7*a*, 7*b* surrounding the recesses 2*a*, 2*b*. The material must be relatively rigid, so that it does not yield too much under the weight of bathers. When choosing material account should also be taken of the fact that the weight of the bottom elements must not be too great, and naturally the material must be impervious to the fluid used, which usually means waterproof, and be resistant to the fluid and any additives to the fluid. The use of a completely or partly transparent material is not only for aesthetic reasons, but has the technical effect that it makes it easier to observe when the chambers ought to be cleaned. On the basis of these considerations clear or shaded acryl has been found to be a preferred material.

Figure 3:
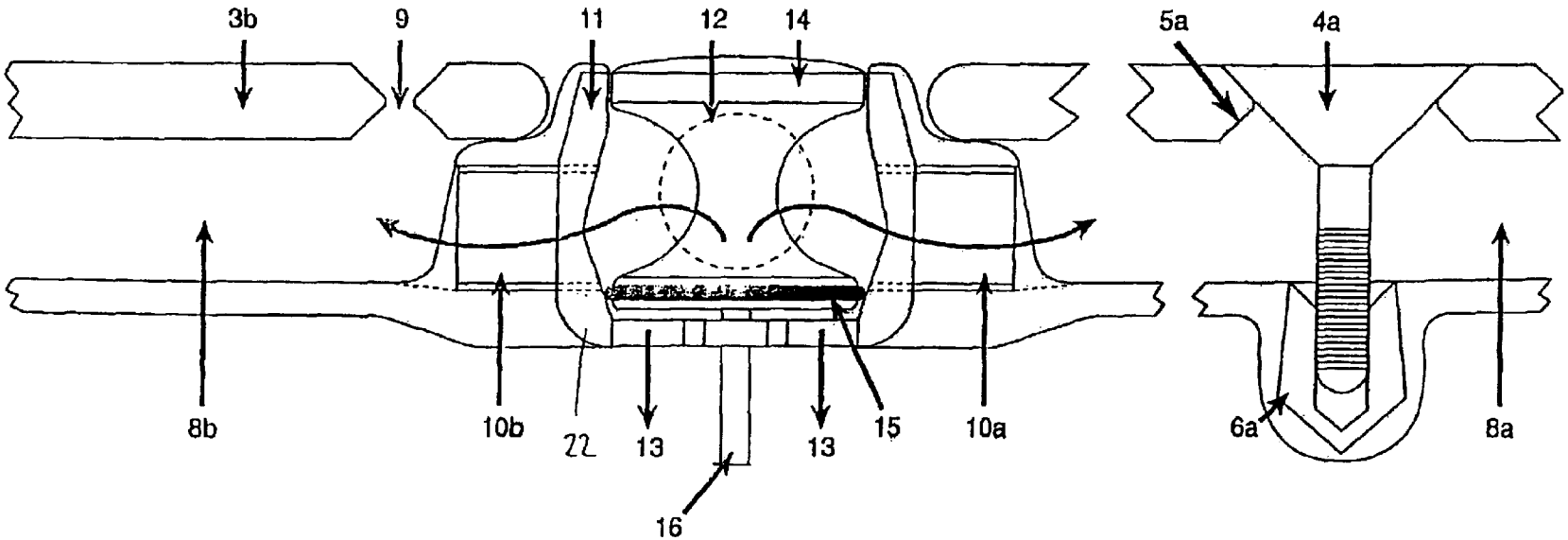
FIG. 3 illustrates a valve device for use with a bathtub according to the invention.

FIG. 3 illustrates an embodiment of the valve device 11 in closer detail, viewed from side C in FIG. 2. The valve device 11 has two functions. It is partly intended to receive a first fluid, normally air, from the inlet 12, illustrated by a dotted circle, and distribute the first fluid to the outlets 10*a*, 10*b* for supply to the chambers 8*a*, 8*b*. The valve device 11 is also partly intended to act as a drain valve for a second fluid, normally water, from the bathtub 1 to a plug hole 13 for the second fluid. The valve device comprises a housing 22, equipped with a first, essentially horizontal inlet 12 for the first fluid, at least two essentially horizontal outlets 10*a*, 10*b* for the first fluid, an upper, and a lower, vertical plug hole 13 for the second fluid. At the plug hole 13 the housing 22 has a conical shape which forms a valve seat. Inside the housing there is mounted a closing device 14 which around a lower part comprises a seal 15, preferably in the form of an O-ring. The closing device 14 is connected to a lifting device 16 which can move the closing device from a closed, lower position to an open, non-illustrated upper position. The lifting device 16 can be operated by a person using the bathtub, by means of known per se, non-illustrated mechanical transfer devices, for example a linkage rod. The closing device 14 with the seal 15 is arranged to close the plug hole 13 in the closed state, i.e. the lifting device's lower position, thus preventing the passage of the second fluid. In the open state, i.e. the lifting device's upper position, the closing device will permit the second fluid to pass from the bathtub down into the plug hole 13.

The valve device 11 combines the supply and drainage functions for the first and second fluids respectively in a particularly effective manner, where the supply means for the first fluid, normally air, have been made very short. The closing device 14 is vertically removable for cleaning, and when the closing device 14 is removed, easy access is gained to the internal parts of the valve device, including the outlets 10*a*, 10*b*, for cleaning, thereby providing easy cleaning and little formation of deposits, growth and so on.

Where the bathtub is provided with more than two recesses with associated bottom elements in the tub part in substantially the same horizontal plane, for example three recesses and three bottom elements, the valve device will have a corresponding number of outlets for the first fluid, arranged in a suitable manner distributed round the circumference of the valve device, with the result that both the outlets and the inlet for the first fluid are as short as possible.

By providing bathtubs of different types with two or more equal-sized recesses, the same type of bottom element can be employed in the different bathtubs. As a result the production of the bottom elements becomes considerably simpler and far more cost-effective than if the bottom elements had a shape adapted to suit the bottom of each type of bathtub.

The requirements regarding precision in the construction of the bottom elements are substantially reduced, since it is far easier to produce bottom elements which are flat than bottom elements which have a high precision in the radial direction. According to the invention it thereby becomes far simpler to achieve an adequate match between the bottom element and the edges surrounding the recesses in the lower bottom. Obtaining a match becomes particularly easy where the bottom elements are circular, where a fixing screw mounted in the centre of the bottom element provides a uniform distribution of force along the circumference, resulting in a uniform, tight seal. A special advantage of a simple and cost-effective production of the bottom elements is that it is possible to replace the bottom elements with new bottom elements of an alternative design in a simple and inexpensive manner. Such alternative bottom elements may have the same external shape, while other characteristics such as, for example, number, size, design and/or distribution of nozzle apertures, or characteristics associated with material, surface design or colour, may be different. By providing the bathtub with two or more recesses and bottom elements, the simultaneous advantage is obtained that a valve device as described gives an efficient distribution of the first fluid to the two chambers under the bottom elements in the tub, with short supply channels. The drawbacks mentioned at the beginning with which previously known solutions are encumbered are thereby avoided.

What is claimed is:

1. A whirlpool bathtub comprising a tub part for holding water having a bottom, at least one recess in the bottom of the tub part, a substantially horizontal sealing edge surrounding the at least one recess, a releasable bottom element covering the at least one recess which abuts sealingly against the sealing edge, the at least one recess and the bottom element together forming a distributing chamber for air, a plurality of through-flow apertures in the bottom element for supplying air from the distributing chamber to the water in tub part and at least one device for supplying air to the distributing chamber, wherein the sealing edge and the bottom element are circular and are symmetrical about a vertical axis through a central area of the at least one recess, and the bottom element is provided with a centrally located attachment device which acts together with a corresponding attachment device in the central area of the at least one recess to releasably hold the bottom element in place.

2. The whirlpool bathtub of claim 1, having at least two identically shaped recesses in the bottom of the tub part, each having the sealing edge and the associated releasable bottom element.

3. The whirlpool bathtub of claim 2, wherein the at least two recesses are supplied with air from the same at least one device for supplying air.

4. The whirlpool bathtub of claim 1, wherein the bottom elements' through-flow apertures are arranged asymmetrically about the vertical axis.

5. The whirlpool bathtub of claim 1, wherein the bottom element is rotatable about the centrally located attachment device for rotating the bottom element to a desired position with regard to the position of the through-flow apertures.

6. The whirlpool bathtub of claim 1, wherein the at least one device for supplying air is a device for supplying air and draining water.

7. The whirlpool bathtub of claim 6, wherein the at least one device for supplying air and draining water is a valve device having a housing which is provided with an inlet for air and an outlet for air to the at least one recess, an inlet for water from the whirlpool bathtub and an outlet for water, and a valve for closing the outlet for water.

* * * * *